US007946359B2

(12) United States Patent
Jeffryes et al.

(10) Patent No.: US 7,946,359 B2
(45) Date of Patent: May 24, 2011

(54) METHODS AND APPARATUS FOR WELL CONSTRUCTION

(75) Inventors: Benjamin Jeffryes, Cambridge (GB); Louise Bailey, St. Neots (GB); Iain Cooper, Texas, TX (US); Geoffrey Maitland, Cambridge (GB); Dominique Guillot, Somerville, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 202 days.

(21) Appl. No.: 12/097,368

(22) PCT Filed: Dec. 6, 2006

(86) PCT No.: PCT/EP2006/011808

§ 371 (c)(1),
(2), (4) Date: Nov. 13, 2008

(87) PCT Pub. No.: WO2007/068397

PCT Pub. Date: Jun. 21, 2007

(65) Prior Publication Data

US 2009/0178809 A1 Jul. 16, 2009

(30) Foreign Application Priority Data

Dec. 14, 2005 (EP) ..... 05292716

(51) Int. Cl.
*E21B 7/00* (2006.01)

(52) U.S. Cl. ..... 175/57; 175/99; 175/325.1; 175/325.5

(58) Field of Classification Search ..... 175/57, 175/99, 65, 325.1, 325.5
See application file for complete search history.

(56) References Cited

U.S. PATENT DOCUMENTS

| | | | | |
|---|---|---|---|---|
| 3,812,912 | A * | 5/1974 | Wuenschel | 166/207 |
| 4,501,337 | A | 2/1985 | Dickinson, III et al. | |
| 4,640,313 | A | 2/1987 | Stanley et al. | |
| 5,803,666 | A * | 9/1998 | Keller | 405/146 |
| 5,816,345 | A | 10/1998 | Keller et al. | |
| 6,109,828 | A * | 8/2000 | Keller | 405/146 |
| 6,923,263 | B2 * | 8/2005 | Eden et al. | 166/288 |
| 7,243,732 | B2 * | 7/2007 | Richard | 166/387 |
| 7,387,174 | B2 * | 6/2008 | Lurie | 175/57 |
| 7,392,852 | B2 * | 7/2008 | Richard | 166/387 |

(Continued)

FOREIGN PATENT DOCUMENTS

DE 1189492 3/1965

(Continued)

*Primary Examiner* — William P Neuder
*Assistant Examiner* — Elizabeth C Gottlieb
(74) *Attorney, Agent, or Firm* — David Cate; Robin Nava; Jeffrey Griffin

(57) ABSTRACT

A method of constructing a borehole drilled with a drilling apparatus (16), the method comprises: connecting a flexible tubular liner sleeve (22) around the outside of the drilling apparatus and connecting the sleeve around an upper opening of the borehole so as to pass into the borehole; progressively extending the sleeve into the borehole as drilling progresses while maintaining connection to the drilling apparatus and borehole opening; at a predetermined point in the drilling, expanding the sleeve so as to contact the borehole wall; and setting the sleeve so as to be fixed to the borehole wall after expansion. Apparatus for use in such a method comprises: a flexible, expandable sleeve (22); a first connector for connecting the sleeve around the outside of a drilling assembly; and a second connector for connecting the sleeve around the opening of the borehole; wherein the sleeve is arranged to extend through the borehole between the connectors as drilling progresses.

26 Claims, 3 Drawing Sheets

U.S. PATENT DOCUMENTS

| | | | | |
|---|---|---|---|---|
| 7,455,104 | B2 * | 11/2008 | Duhon et al. | 166/57 |
| 7,478,686 | B2 * | 1/2009 | Richard et al. | 175/57 |
| 2005/0172710 | A1 * | 8/2005 | Keller | 73/152.41 |
| 2006/0124304 | A1 * | 6/2006 | Bloess et al. | 166/285 |

FOREIGN PATENT DOCUMENTS

| | | |
|---|---|---|
| SU | 1527412 | 3/1986 |
| WO | WO-2004051129 | 6/2004 |
| WO | WO-2005024178 | 3/2005 |

* cited by examiner

METHODS AND APPARATUS FOR WELL CONSTRUCTION

TECHNICAL FIELD

This invention relates to methods and apparatus for zonal isolation and borehole stabilisation that are particularly applicable to boreholes such as oil and gas wells, or the like. They provide techniques that can be used in addition to or as an alternative to conventional well completion techniques such as cementing.

BACKGROUND ART

Completion of boreholes by casing and cementing is well known. Following drilling of the borehole, a tubular casing, typically formed from steel tubes in an end to end string is placed in the borehole and cement is pumped through the casing and into the annulus formed between the casing and the borehole wall. Once set, the cemented casing provides physical support for the borehole and prevents fluid communication between the various formations or from the formations to the surface (zonal isolation). However, problems can occur if drilling mud remains in the borehole when the cement is placed, or microannuli form around the casing and/or borehole wall. The effect of these can be to provide fluid communication paths between the various formations or back to the surface and consequent loss of zonal isolation.

There are various well-known problems associated with conventional cementing operations. For example, drilling must be interrupted and the drill string withdrawn from the borehole each time a casing is to be set; and each casing reduces the diameter of the well.

WO 9706346 A (DRILLFLEX) 20 Feb. 1997 describes a technique in which a tubular preform is introduced into a well on an electric cable and expanded into contact with the wall of the well by inflation of a sleeve located inside the preform. Once inflated, the preform is solidified by polymerisation, typically by heating by means of an embedded heating wire, or by introduction of a heated liquid into the sleeve. Such a technique is typically used for repair of a casing or tubing that is already installed in the well, or to shut off perforations that are producing unwanted fluid such as water (see, for example, the PatchFlex service of Schlumberger/Drillflex).

This invention aims to address some of the known problems with borehole lining by providing a technique that can reduce the interruption to drilling and decrease in borehole diameter.

DISCLOSURE OF THE INVENTION

This invention is based on the extrustion or continuous placement of a concentric sleeve around a drill string that can be made to expand to line the borehole.

A first aspect of this invention provides method of constructing a borehole drilled with a drilling apparatus, the method comprising:

connecting a flexible tubular liner sleeve around the outside of the drilling apparatus and connecting the sleeve around an upper opening of the borehole so as to pass into the borehole;

progressively extending the sleeve into the borehole as drilling progresses while maintaining connection to the drilling apparatus and borehole opening;

at a predetermined point in the drilling, expanding the sleeve so as to contact the borehole wall; and setting the sleeve so as to be fixed to the borehole wall after expansion.

A method preferably comprises positioning the sleeve on a spool located at the borehole opening and spooling the sleeve into the well as drilling progresses, or positioning the sleeve on a spool located around the drilling apparatus and spooling the sleeve into the well as drilling progresses. The spool can hold the sleeve in a rolled or folded/pleated form prior to extension into the borehole.

Expanding the sleeve can be achieved by pumping a fluid under pressure into the sleeve.

It is also preferred to heat the sleeve prior to expansion to improve flexibility. After heating and expansion, the sleeve can be cooled so as to set the sleeve in its expanded state.

Where the sleeve comprises a polymer, the method preferably comprises heating to a temperature above the glass transition temperature, Tg, of the polymer prior to expansion, and cooling to a temperature below Tg after expansion.

Heating the sleeve can be achieved, for example, by means of a fluid used to expand the sleeve, by means of an electrical heating element, or by means of an exothermic reaction.

A second aspect of the invention comprises apparatus for use in a method according to the first aspect, comprising:

a flexible, expandable sleeve;

a first connector for connecting the sleeve around the outside of a drilling assembly; and a second connector for connecting the sleeve around the opening of the borehole;

wherein the sleeve is arranged to extend through the borehole between the connectors as drilling progresses.

The apparatus preferably comprises a spool on which the sleeve is held and from which the sleeve is withdrawn as drilling progresses. The sleeve can be rolled on the spool or held in a pleated or folded form. The spool can be located at the first connector or the second connector.

Preferably, the apparatus also comprises a supply of pressurised fluid that allows the fluid to be pumped inside the sleeve so as to expand it into contact with the borehole wall. The drilling assembly can include ports for the delivery of fluid from the supply to the inside of the sleeve. The fluid can be drilling mud, for example.

The flexible sleeve can be formed from a polymer that is expandable when heated above Tg but sets in position when cooled below Tg. The sleeve can include heating elements and/or reinforcing elements. Other materials that can be used include thin metal sheets or foils, woven fibres and composite materials including reinforcing elements such as cross-weave fibres.

Downhole temperatures may be sufficiently high that the sleeve already has sufficient deformability for expansion and it is merely necessary to pump in fluid to cause expansion. Further softening of the sleeve may be used to improve flexibility for expansion.

MODE(S) FOR CARRYING OUT THE INVENTION

Figure 1:
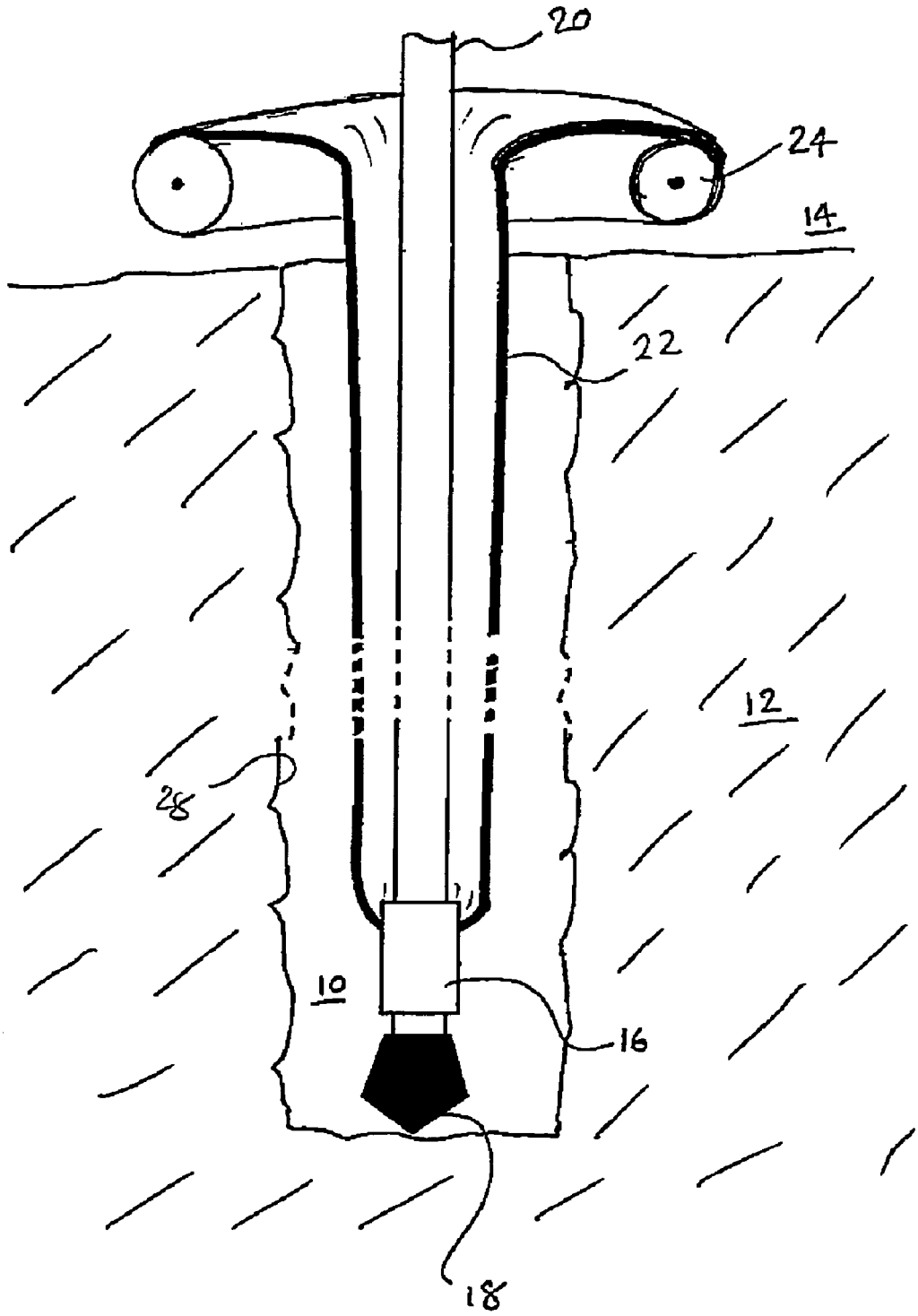
FIG. 1 shows a schematic view of a first embodiment of an apparatus according to the invention.

Referring now to the drawings, FIG. 1 shows a first embodiment of an apparatus according to the invention that can be used to line a borehole 10 drilled through underground formations 12 from the surface 14. The drilling operation is conducted using a drilling apparatus 16 carrying, inter alia, a drill bit 18. The drilling apparatus 16 is carried on the end of a drill string 20 that extends through the borehole 10 from the surface 14. The drill bit 18 is rotated by rotation of the drill string 20 and/or by use of a downhole motor forming part of the drilling apparatus 16. A flexible, tubular liner sleeve 22 extends concentrically around the drill string 20 through the borehole 10. The sleeve 22 is connected around the outside of the top of the drill string 20, at the upper opening of the borehole 10 by a spool 24 on which the sleeve is rolled. The sleeve 22 is connected at the lower end of the drill string 20 at the drilling assembly 16.

As the drilling progresses, the drill string is lengthened (for example by adding drill pipe or by unreeling from a coil) and the sleeve 22 is correspondingly extended by unrolling from the spool 24. The sleeve 22 is later expanded to line the borehole 10 as will be explained below.

Figure 2:
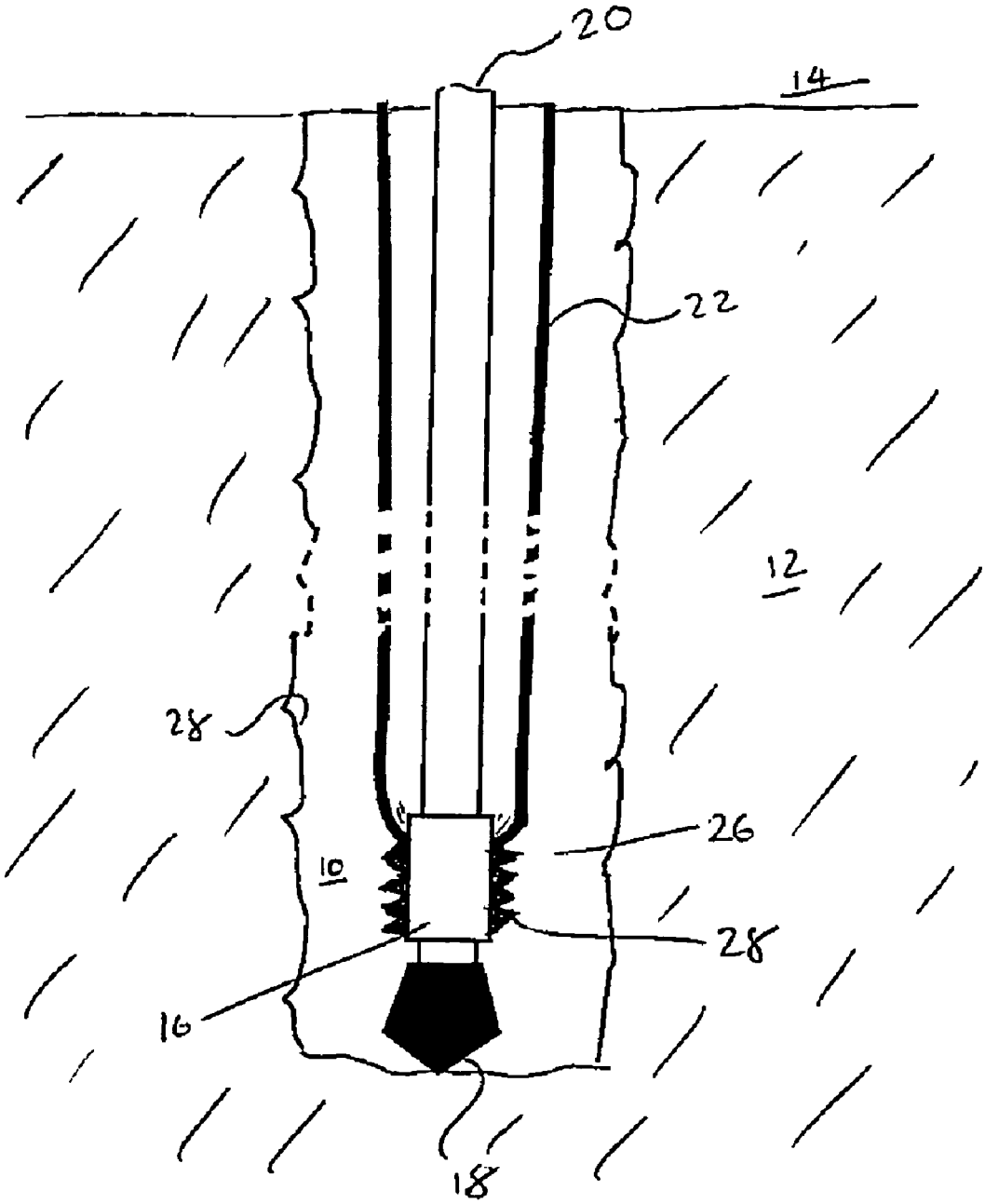
FIG. 2 shows a schematic view of a second embodiment of an apparatus according to the invention.

FIG. 2 shows an alternative embodiment to that of FIG. 1. In this case. the sleeve 22 is fixed at the opening of the borehole and is held on a downhole spool 26 connected to the drilling assembly 16. The sleeve is held on the downhole spool 26 in a pleated or folded arrangement 28 as opposed to the roll 24 of the embodiment of FIG. 1. As drilling progresses, the sleeve 22 extends by unfolding from the downhole spool 26.

It will be appreciated that the two forms of spool shown in FIGS. 1 and 2 are interchangeable. The surface spool 24 of FIG. 1 could be a folded/pleated arrangement or the downhole spool 26 of FIG. 2 could be a roll.

When drilling has progressed to a depth at which it becomes necessary to line the borehole 10, drilling ceases and the sleeve 22 is expanded to contact the borehole wall 28 and set in place. Expansion is achieved by inflating the sleeve 22 with fluid pumped from the surface, down the drill string 20, through ports 32 in the drilling assembly 16 and into the interior 30 of the sleeve 22. The ports 32 in the drilling assembly 16 can be operated by means of a ball or dart pumped along the drill string 20 or by raising the fluid pressure in the drill string 20 to a suitable level. Alternatively, fluid can be pumped from the surface between the sleeve 22 and drill string 20 (reverse circulation). For the application of a heated fluid (see below), fluid can also be pumped from the surface between the sleeve and borehole wall 28, or through the drilling assembly so as to pass up the borehole between the sleeve 22 and borehole wall 28.

Once the sleeve is set, drilling can proceed. In the embodiment of FIG. 1, it is necessary to disconnect the drilling assembly from the set sleeve and reconnect a loose sleeve from the surface. In the embodiment of FIG. 2, drilling can recommence with the remainder of the original sleeve, or with a new sleeve installed at the surface. In another embodiment, a new spool can be inserted on an expandable ring to locate near the bottom of the previous lining so that the new sleeve overlaps slightly with the bottom of the previous, set sleeve and is pulled down from this downhole spool (similar to FIG. 1). Alternatively, an expandable seal ring can be used to connect to the bottom of the set sleeve and the new sleeve unspoiled from the drilling assembly (similar to FIG. 2).

The sleeve 22 is preferably formed from a thermoplastic polymer that transforms rapidly from a hard, relatively inflexible solid to a flexible, deformable rubber when it is heated above its so-called glass transition temperature Tg. This thermal trigger is used to provide continuous zonal isolation while drilling, so enabling drilling to continue through weak formations and provide continuous lining of the wellbore. While the lining provided by the expanded sleeve may not be sufficiently strong to act as a permanent casing, longer, extended sections can be drilled before steel casing is required, so reducing the number of casing strings required and enabling smaller diameter wells to be drilled to the target zones. Alternatively, where there is little requirement for mechanical reinforcement, the expanded sleeve may be sufficient to act as a permanent liner.

Figure 3:
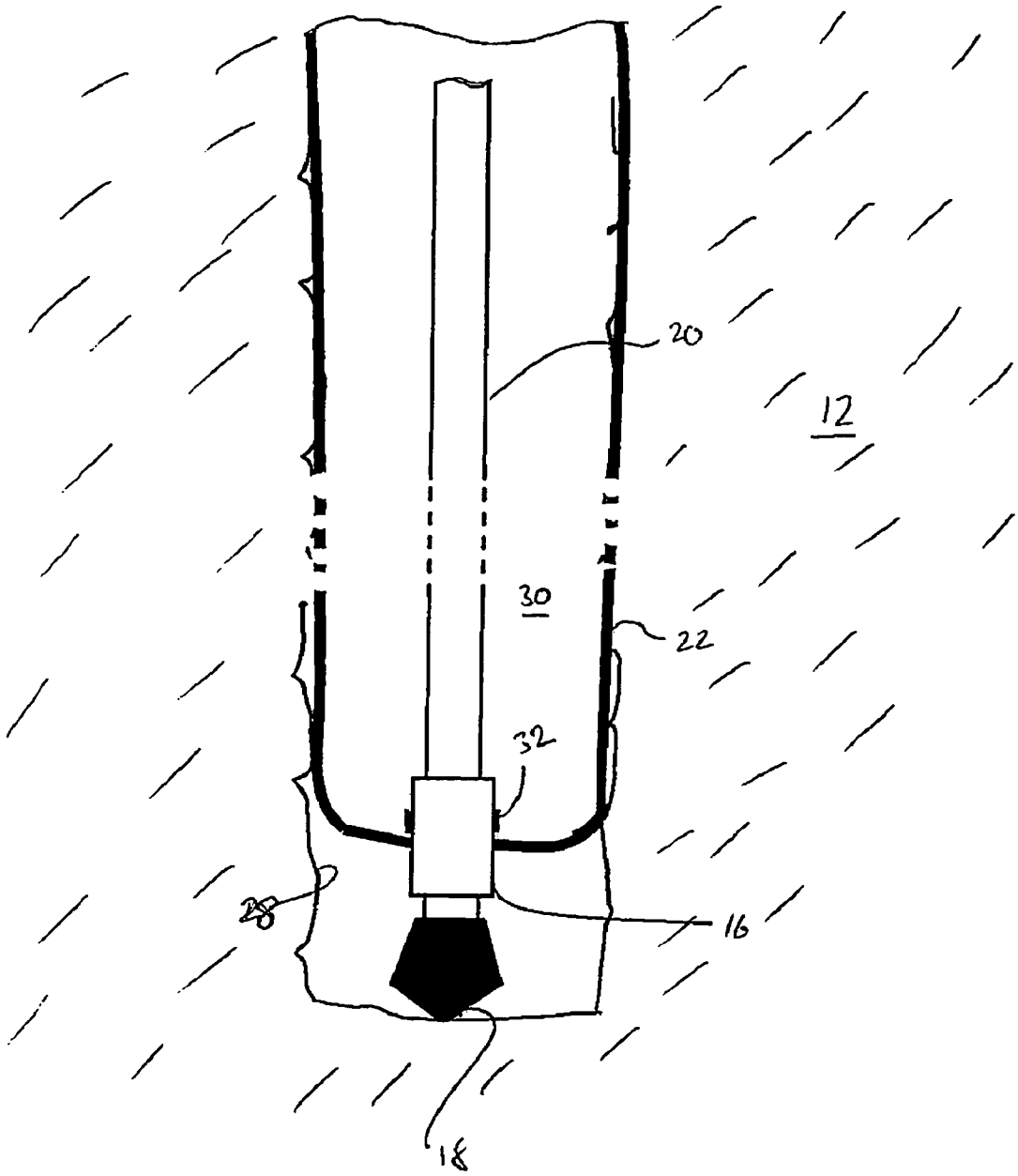
FIG. 3 shows part of the embodiment of FIG. 1 or 2 after expansion.

As is described generally in relation to FIGS. 1-3 above, a continuous tube or sleeve of polymer 22, concentric with the drill string 20, is released from the drilling assembly (BHA) 16 or from the surface 14 as the well is drilled. The diameter of the sleeve 22 is intermediate to that of the drill string 20 and the borehole 10, enabling free circulation of the drilling fluid. The polymer chemical composition can be chosen such that it remains below its Tg for the highest depths to be reached with the borehole 10 (or section of borehole). At a point where zonal isolation and/or support for the borehole wall 28 needs to be achieved (e.g. weak zone), hot fluid at $T>Tg$ is pumped into the polymer sleeve 22 under pressure. This causes the polymer sleeve 22 to soften and then expand like a balloon until it reaches the formation wall 28. The sleeve 22 is compressed against the contours of the rock to take up the precise local shape, seal against the rock and even be pressed into the near wellbore region. Reducing the temperature of the circulating fluid to $T<Tg$ transforms the polymer back to a hard, high modulus solid which now forms a good seal against the formation wall 28 and gives mechanical support to the weaker sections. Drilling can now proceed with a new polymer sleeve, either from surface or secured to overlap with the section already in place.

This method of borehole lining is conveniently applied during the drilling phase, prior to placing cement into the annulus. The choice of polymer material is determined by the glass transition, or softening, temperature (Tg) being higher than the temperature likely to be experienced by the polymer liner during normal operation, both during well construction and production, but such that the polymer tube may readily be raised above this value during the expansion/lining phase. The temperature may be raised in a number of ways: by circulating hot fluid within the sleeve or outside the sleeve (see above), by electrical heating (either by use of a separate heater or by operation of embedded heating elements in the sleeve), by activating an exothermic chemical reaction in the liquid sitting within or surrounding the sleeve etc.

Suitable polymers are exemplified by, but not restricted to: polyolefins (polyethylene, polypropylene, polybutene . . . ), polyalkylmethacrylates (alkyl=methyl, propyl, butyl . . . ), polyvinyl chloride, polysulphones, polyketones, polyamides (such a nylon 6,6), polyesters such as polyalkylene terephalates, and fluorinated polymers (such as PTFE, which will provide low friction with the drillstring and/or casing and so give enhancements for long, extended deviated and horizontal wells) to name but a few. Copolymers and blends of these are also possible.

Composites of these polymers with solid inorganic materials (e.g. carbon black, silica and other minerals), or fibre composites (short fibres or continuous, woven mat) are also possible.

An alternative approach is to use a thermoset, rather than a thermoplastic, polymer material, wherein an uncrosslinked flexible resin sleeve (with or without fibre reinforcement)

blended or impregnated with cross-linker (a 'prepreg') which crosslinks when the sleeve is expanded and its temperature raised sufficiently, so that it changes from a soft, deformable material to a hard, strong seal.

Other materials include those in powder or granular form, held in a bag or other flexible container, e.g. thermoplastic powder or granules in a thin fibre, metal foil or plastic annular sack which fuse against the wellbore wall on expansion and heating of the sleeve.

The sleeve can comprise pre-stressed liner which is prevented from expanding by a polymer below its Tg; on heating the polymer softens, enabling the pre-stressed liner to expand against the formation and form a seal.

Further changes may also be made while staying within the scope of the invention. For example, in the case of a sidetrack or lateral borehole drilled from a main borehole, the sleeve may be connected to the opening of the new borehole in the main borehole rather than at the surface. Also, expansion may be achieved by means of a mechanical device (former) which has a diameter similar to the borehole and can be pushed down the sleeve, or which can expand in the sleeve and be pushed or pulled along to expand the sleeve into contact with the borehole wall.

The invention claimed is:

1. A method of constructing a borehole drilled with a drilling apparatus, the method comprising:

(i) connecting a flexible tubular liner sleeve around the outside of the drilling apparatus and connecting the sleeve around an upper opening of the borehole so as to pass into the borehole, wherein the sleeve comprises a bag comprising a thermoplastic polymer in granular form;

(ii) progressively extending the sleeve into the borehole as drilling progresses while maintaining a connection to the drilling apparatus and the borehole opening;

(iii) at a predetermined point during drilling, heating the sleeve to a temperature above the polymer glass-transition temperature or the polymer, and expanding the sleeve until the sleeve contacts the borehole wall; and (iv) cooling the sleeve below the polymer glass-transition temperature so that the sleeve sets and becomes fixed to the borehole wall after expansion.

2. The method as claimed in claim 1, further comprising positioning the sleeve on a spool located at the borehole opening and spooling the sleeve into the well as drilling progresses.

3. The method as claimed in claim 2, further comprising expanding the sleeve using a mechanical expanding tool.

4. The method as claimed in claim 2, further comprising expanding the sleeve by pumping a fluid under pressure into the sleeve.

5. The method as claimed in claim 1, further comprising positioning the sleeve on a spool located around the drilling apparatus and spooling the sleeve into the well as drilling progresses.

6. The method as claimed in claim 5, further comprising expanding the sleeve using a mechanical expanding tool.

7. The method as claimed in claim 5, further comprising expanding the sleeve by pumping a fluid under pressure into the sleeve.

8. The method as claimed in claim 1, further comprising expanding the sleeve by pumping a fluid under pressure into the sleeve.

9. The method as claimed in claim 1, wherein the sleeve is heated by means of a fluid pumped inside or outside the sleeve.

10. The method as claimed in claim 1, wherein the sleeve is heated by means of an electrical heating element.

11. The method as claimed in claim 1, wherein the sleeve is heated by means of an exothermic reaction.

12. An apparatus for use in the method as claimed in claim 1, comprising:

(i) a flexible, expandable sleeve, comprising a thermoplastic polymer in granular form;

(ii) a first connector for connecting the sleeve around the outside of a drilling assembly; and (iii) a second connector for connecting the sleeve around the opening of the borehole, wherein the sleeve is arranged to extend through the borehole between the connectors as drilling progresses, the sleeve is expandable by heating the sleeve above the polymer glass-transition temperature, and the sleeve is settable by cooling the sleeve below the polymer glass-transition temperature.

13. The apparatus as claimed in claim 12, further comprising a spool on which the sleeve is held and from which the sleeve is withdrawn as drilling progresses.

14. The apparatus as claimed in claim 13, wherein the spool is located at the first connector or the second connector.

15. The apparatus as claimed in claim 12, further comprising a supply of pressurized fluid that allows the fluid to be pumped inside the sleeve so as to expand it into contact with the borehole wall.

16. The apparatus as claimed in claim 15, wherein the drilling assembly includes ports for the delivery of fluid from the supply to the inside of the sleeve.

17. The apparatus as claimed in claim 12, wherein the sleeve further comprises thin metal foil, composite materials or woven fibers.

18. The apparatus as claimed in claim 12, wherein the sleeve contains heating elements.

19. The apparatus as claimed in claim 12, wherein the sleeve contains reinforcing elements.

20. A method of constructing a borehole drilled with a drilling apparatus, the method comprising:

(i) connecting a flexible tubular liner sleeve around the outside of the drilling apparatus and connecting the sleeve around an upper opening of the borehole so as to pass into the borehole, wherein the sleeve comprises a bag comprising a thermoset polymer in granular form;

(ii) progressively extending the sleeve into the borehole as drilling progresses while maintaining a connection to the drilling apparatus and the borehole opening;

(iii) at a predetermined point during drilling, expanding the sleeve until the sleeve contacts the borehole wall; and (iv) heating the sleeve to a temperature at which the polymer sets, so that the sleeve becomes fixed to the borehole wall after expansion.

21. The method as claimed in claim 20, further comprising expanding the sleeve by pumping a fluid under pressure into the sleeve.

22. The method as claimed in claim 20, wherein the sleeve is heated by means of a fluid pumped inside or outside the sleeve.

23. The method as claimed in claim 20, wherein the sleeve is heated by means of an electrical heating element.

24. The method as claimed in claim 20, wherein the sleeve is heated by means of an exothermic reaction.

25. An apparatus for use in the method as claimed in claim 20, comprising:

(i) a flexible, expandable sleeve, comprising a thermoset polymer in granular form;

(ii) a first connector for connecting the sleeve around the outside of a drilling assembly; and (iii) a second connector for connecting the sleeve around the opening of the borehole, wherein the sleeve is arranged to extend through the borehole between the connectors as drilling progresses, and the sleeve is expandable until the sleeve is heated to a temperature above the polymer-setting temperature.

26. The apparatus as claimed in claim 25, further comprising a supply of pressurized fluid that allows the fluid to be pumped inside the sleeve so as to expand it into contact with the borehole wall.

* * * * *